United States Patent [19]

Fischer

[11] Patent Number: 4,808,039

[45] Date of Patent: Feb. 28, 1989

[54] COUPLING MECHANISM FOR INTERCONNECTING SEALING PLATES THAT ARE TO BE BUILT INTO A SEALING WALL

[76] Inventor: Joachim Fischer, Saarwerdenstrasse 41, D-4047 Dormagen 5, Fed. Rep. of Germany

[21] Appl. No.: 149,719

[22] Filed: Jan. 29, 1988

[30] Foreign Application Priority Data

Feb. 3, 1987 [DE] Fed. Rep. of Germany ..... 3703066

[51] Int. Cl.[4] ..... E02D 5/02; E02D 5/08; E02D 5/14; E02D 19/18

[52] U.S. Cl. ..... 405/281; 405/279; 405/278; 405/276; 405/274; 405/128; 52/588

[58] Field of Search ..... 405/274–281, 405/128, 129; 52/588

[56] References Cited

U.S. PATENT DOCUMENTS

| | | | |
|---|---|---|---|
| 2,027,288 | 1/1936 | Prielipp | 405/280 |
| 2,128,428 | 8/1938 | Murray | 405/278 |
| 2,355,102 | 8/1944 | Odman | 405/278 |
| 2,880,589 | 4/1959 | Wilson et al. | 405/281 |
| 3,601,946 | 8/1971 | Rothemund | 52/588 X |

FOREIGN PATENT DOCUMENTS

| | | | |
|---|---|---|---|
| 304018 | 11/1916 | Fed. Rep. of Germany | 405/278 |
| 513105 | 11/1930 | Fed. Rep. of Germany | 405/281 |
| 3436735 | 4/1986 | Fed. Rep. of Germany . | |
| 640409 | 5/1962 | Italy | 52/588 |

*Primary Examiner*—Randolph A. Reese
*Assistant Examiner*—John A. Ricci
*Attorney, Agent, or Firm*—Becker & Becker, Inc

[57] ABSTRACT

A coupling mechanism for the interconnection of sealing plates. Symmetrical coupling halves of the sealing plates are interconnected and welded together to form a hollow space that can be checked. Each coupling half has a free edge that is provided with a C-shaped profiled connecting part. That edge of the coupling half where it is attached to a sealing plate is provided with a notch-like part that is symmetrical to the C-shaped connecting part. A sealing strip projects into the hollow space from the transition area between the notch-like part and the adjoining wall. This sealing strip can be welded to the transition area of the cooperating coupling half between the C-shaped connecting part and the adjoining wall thereof.

7 Claims, 1 Drawing Sheet

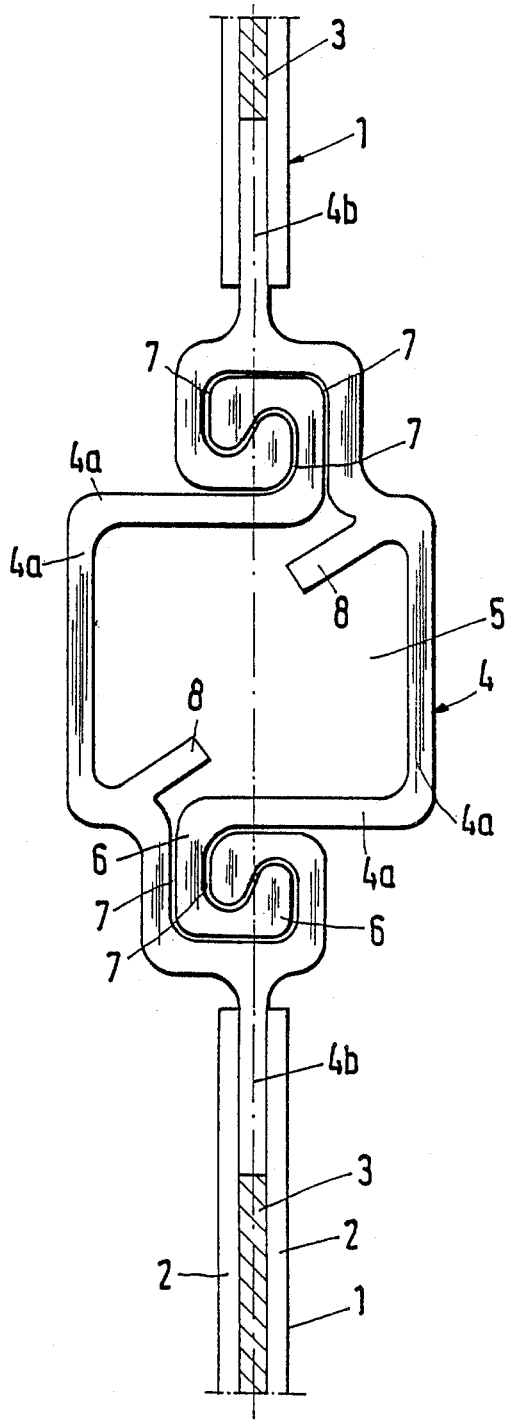
3
1
4b
7
7
7
4a
4a
8
5
4
8
4a
6
4a
7
6
7
4b
3
2
2
1

COUPLING MECHANISM FOR INTERCONNECTING SEALING PLATES THAT ARE TO BE BUILT INTO A SEALING WALL

BACKGROUND OF THE INVENTION

The present invention relates to a coupling mechanism for the interconnection of sealing plates preferably plastic sealing plates that are to be built into a sealing wall, especially a slotted wall for the vertical sealing of ground storages or dumps; each sealing plate has sides for example vertical sides, at least some of which are provided with a coupling half, preferably also of plastic, whereby adjacent coupling halves of adjacent sealing plates cooperate in a formfitting, interlocking manner to effect the interconnection of the sealing plates and to form a hollow space that can be checked.

For the production of sealing walls for earthwork and hydraulic engineering purposes, as well as for the sealing of dumps, it is known to build plastic sealing plates into such sealing walls. The plastic sealing plates are needed as an additional sealing layer because the material of the sealing walls, which are made of binder and/or silicate material, has a permeability that cannot be tolerated when dumps are to be sealed. To achieve the additional sealing by means of the sealing plates that are to be built into the sealing wall, the vertical sides of these sealing plates have to be interconnected in an impervious manner i.e. in such a way as to provide a liquidtight seal. With the heretofore known constructions, this is effected by coupling halves that are disposed on adjacent sealing plates and that fit together in an interlocking manner.

As disclosed in one heretofore known arrangement of sealing plates ( German Offenlegungsschrift No. 34 36 735), after being fitted together the two coupling halves form a void or hollow space that can be equipped for checking the seal or imperviousness of the connection between adjacent sealing plates. This checking can be effected either only after the interconnection, or continuously in the latter case, periodic or continuous monitoring is possible.

Since sealing walls are usually produced accompanied by the use of a supporting liquid, which gets into the hollow space during the interconnection of the sealing plates, it is necessary to clean the hollow space after the interconnection is completed. This procedure has to be repeated for each new interconnection of sealing plates. To accomplish this cleaning, it is first necessary to close off the base of the hollow space with a sealing material or a "packer" before the supporting liquid, which may even include pollutants, can be removed from the hollow space and the latter can be cleaned.

In the heretofore known embodiment of the aforementioned German Offenlegungsschrift No. 34 36 735, the hollow space is primarily formed by two tubular coupling halves. The first coupling half has a diameter that is greater than that of a second coupling half, and surrounds the latter. Remote ±rom its sealing plate each coupling half is provided with a slot, with the sealing wall that is connected to the smaller coupling half projecting through the slot of the larger coupling half. Formed on the outer surface of the inner coupling half are sealing beads that also rest against the inner surface of the outer coupling half in an attempt to provide a seal.

A drawback of this heretofore known construction is that due to the considerable amount of play between the inner coupling tube and the outer coupling tube, especially under the harsh conditions encountered in practice, the sealing effect between the two coupling halves is not sufficient, after the supporting liquid has been pumped out of the hollow space and the latter has been cleaned, to reliably prevent more supporting liquid from penetrating into the hollow space. When this happens, the supporting liquid penetrates especially into that area between the cooperating coupling halves that was to be welded together subsequent to the cleaning operation. Thus it becomes difficult to drain this hollow space, clean the latter, and obtain an impervious weld. A further drawback of the heretofore known construction is that the hollow space provides very little guidance during the interconnection of the coupling halves. In addition, the two round profiles that are inserted into one another offer little resistance to being pulled apart. Yet another drawback is the absence of a guide for the tools that will later be used.

It is an object of the present invention to provide a configuration for the coupling halves where after the interconnection of the same, yet prior to welding together thereof, an adequately impervious connection is provided, whereupon the subsequent welding of the coupling halves provides impervious welds, with the configuration of the coupling halves also providing guiding properties that prevent the coupling halves from pulling apart during assembly.

BRIEF DESCRIPTION OF THE DRAWING

This object, and other objects and advantages of the present invention, will appear more clearly from the following specification in conjunction with the accompanying schematic drawing, which is a plan view of one exemplary embodiment of the inventive arrangement.

SUMMARY OF THE INVENTION

The coupling mechanism of the present invention is characterized primarily in that each coupling half has an edge that is connected to a sealing plate, a blockout or notch-like portion that adjoins this edge, wall section means adjoining the notch-like portion and defining, in conjunction with the wall section means of a cooperating coupling half, the hollow space, and a profiled connecting part that adjoins the wall section means and forms another edge of that coupling half, with the profiled connecting part having a C-shaped cross-sectional shape and the notch-like portion having a corresponding shape, and with the profiled connecting part of one coupling half cooperating with the notch-like portion of the adjacent coupling half to provide the interlocking interconnection of the sealing plates; each coupling half also has a sealing strip that is disposed where the notch-like portion adjoins the wall section means and that when the profiled connecting part of one coupling half and the notch-like portion of an adjacent coupling half first cooperate with one another, projects into the hollow space defined by the wall section means of these two cooperating coupling halves; to seal the cooperating profiled connecting parts and notchshaped portions of two interlocking coupling halves, the sealing strip of one of the coupling halves can be welded, for example by heat-sealing, to that portion of the other coupling half where the profiled connecting part of the latter adjoins the wall section means thereof.

This inventive configuration of the coupling halves offers the advantage of being able to provide a sealing wall that enables a reliable interconnection of sealing plates, and that already immediately after such interconnection is impervious enough to allow complete draining of the hollow space that is formed by the coupling halves, and to prevent supporting liquid from entering the hollow space until the subsequent welding process is completed. The corners that result from the configuration of the hollow space, which can have four or more corners, serve to support and guide tools, such as cleaning and connecting tools, that are used within the hollow space. A particular advantage provided by the present invention is that the C-shaped profiled connecting part, and the symmetrical notch-like part, form a labyrinth seal that on the one hand cleans itself when the two coupling halves are vertically fitted together, and that on the other hand forms a seal that is effective even over a long period of time, so that after the hollow space has been drained, no more supporting liquid can enter therein. Since the sealing strip, which is formed where the notch-like part merges with the wall that helps to define the hollow space, projects into the hollow space, this sealing strip is very accessible and can therefore be easily cleaned after the hollow space has been drained. As a matter of fact, the sealing strip can be cleaned together with the transition area of the other coupling half between the C-shaped connecting part and the wall that helps to define the hollow space. Subsequent to this cleaning operation, the sealing strip is welded to this last-mentioned transition area. Since it is those parts of the coupling halves which can be reliably cleaned and are easily accessible that are welded together, impervious welds result without the necessity of having to clean, or to use for the welding process, those sealing surfaces that are necessary for the time period between the draining of the hollow space and the welding process, and that for all practical purposes are inaccessible.

On the whole, the present invention provides a construction that on the one hand enables a simple application even under the difficult conditions often encountered in practice, especially with respect to a reliable assembly, and that on the other hand enables a reliable sealing of the hollow space to be achieved with an improved procedure.

Pursuant to a further specific embodiment of the present invention, that edge of each coupling half that adjoins the notch-like part can be provided with a bar or rib via which the coupling half can be welded to a hollow or solid sealing plate. Pursuant to one preferred specific embodiment of the present invention, this rib is inserted into a gap or space between two parallel plates, which are preferably made of plastic, with the rib then being welded to these plates. In this way, a two-layer sealing plate results to which coupling halves are connected in an impervious manner. The space between the two plates can be formed in various ways.

Further specific features of the present invention will be described in detail subsequently.

DESCRIPTION OF PREFERRED EMBODIMENTS

Referring now to the drawing in detail, the illustrated exemplary embodiment shows two sealing plates 1, each of which is formed from two parallel plastic plates 2. The space between these two plates 2 is filled with a space-former, such as a grid 3. The horizontal foot and head seam of each sealing plate 1 is sealed tightly by welding, e.g. extrusion welding, so as to be impervious. Inserted between the two vertical edges of each sealing plate 1 is a bar or rib **4*b* of one clutch half 4, which is in the form of a profiled member and is also made of plastic. As shown in the drawing, the walls 4*a* of two cooperating coupling halves 4 form a void or hollow space 5. It should be noted that the sealing plates 1 and the coupling halves 4** could also be made of metal, such as steel or aluminum.

The actual connection of adjacent coupling halves 4 is achieved via the profiled connecting part 6 that is formed on the free edge of the wall **4*a* and has a C-shaped cross-sectional shape. When the two coupling halves 4 are joined together vertically, the connecting part 6 of each coupling half 4 is inserted into a blockout or notch-like part 7. Each notch-like part 7 has a cross sectional shape that is symmetrical to that of the connecting part 6, and adjoins a rib 4*b*. Thus, a labyrinth seal is formed when a connecting part 6 is inserted into a notch-like part 7. Such a labyrinth seal assures adequate sealing of the hollow space 5, especially if the latter has to be drained and cleaned after two adjacent sealing plates 1 are fitted together. Prior to such a draining and cleaning, the base of the hollow space 5** has to be appropriately sealed, for example by means of a resin.

Where the wall **4*a* of each coupling half 4 merges with the notch-like part 7, a sealing border or strip 8 is formed on the inner surface of that coupling half; this sealing strip 8 projects at an angle into the hollow space 5. In this way, not only can the surface of the sealing strip B itself be reliably clean, but the surface of the adjacent wall 4*a* of the same coupling half 4 as well as the area where the wall 4*a* of the cooperating coupling half 4 joins with its connecting part 6 can be reliably cleaned. This assures that during subsequent connection, especially by welding the sealing strip 8 to the adjacent transition between the connecting part 6 and the wall 4*a* of the cooperating coupling half 4, an impervious weld or joint is achieved that reliably prevents a soaking or penetration of liquids or pollutants into the hollow space 5, or even prevents an entering of these liquids and pollutants into the region of the labyrinth seals of the coupling halves 4. The welding process is preferably carried out by using a heating wedge, which is guided by the edges of the hollow space 5 and passes between the sealing strip 8 and the adjacent wall 4*a* to effect plasticizing of the plastic, before the sealing strip B is pressed, preferably by pressure rollers, against the adjacent transition area between the connecting part 6 and the wall 4*a***.

Subsequent and even continuous control and checking of the hollow space 5 can be effected by excess pressure, a vacuum, an indicator liquid, by monitoring the pH value, via electrodes, or by some other means.

The present invention is, of course, in no way restricted to the specific disclosure of the specification and drawing, but also encompasses any modifications within the scope of the appended claims.

What I claim is:

1. In a coupling mechanism for the interconnection of sealing plates that are to be built into a sealing wall, where each of said sealing plates has sides, at least some of which are provided with a coupling half, with adjacent coupling halves of adjacent sealing plates cooperating in a formfitting and interlocking manner to effect said interconnection of said sealing plates and to form a hollow space that can be checked, the improvement wherein:

each of said coupling halves has a first edge portion that is connected to a sealing plate, a notch-like part that adjoins said first edge portion, wall section means adjoining said notch-like part and defining, in conjunction with the wall section means of a cooperating coupling half, said hollow space, and a profiled connecting part that adjoins said wall section means and forms a second edge portion of each coupling half, with said profiled connecting part having a C-shaped cross-sectional shape, and said notch-like part having a corresponding shape, and with the profiled connecting part of one coupling half cooperating with the notch-like part of the cooperating coupling half to provide said interlocking interconnection of said sealing plates; each of said coupling halves is also provided with a sealing strip that is disposed where said notch-like part adjoins said wall section means and that, when the profiled connecting part of one coupling half and the notch-like part of a cooperating coupling half first cooperate with one another, projects into said hollow space defined by said wall sections means of these two cooperating coupling halves; to seal the cooperating profiled connecting parts and notch-like parts of two interlocking coupling halves, said sealing strip of one coupling half can be welded to that portion of the other coupling half where the profiled connecting part of the latter adjoins the wall section means thereof.

2. A coupling mechanism according to claim 1, in which said first edge portion of each coupling half that is connected to a sealing plate is in the form of a rib that adjoins said notch-like part.

3. A coupling mechanism according to claim 2, in which said sealing plate is solid.

4. A coupling mechanism according to claim 2, in which said sealing plate is hollow.

5. A coupling mechanism according to claim 2, in which said sealing plate is formed from two plastic plates that are separated by a space into which said rib is inserted with said rib being welded to said plates.

6. A coupling mechanism according to claim 1, in which said wall section means of each of said coupling halves comprises at least two wall sections that are disposed at an angle to one another, whereby said hollow space defined by the wall sections of cooperating coupling halves has at least four corners for the reliable guidance of cleaning and connecting tools introduced into said hollow space.

7. A coupling mechanism according to claim 1, in which cooperating ones of said profiled connecting pars and said notch-like parts form a labyrinth-like connection that is adequately impervious and counteracts forces that tend to pull said connection apart.

* * * * *